United States Patent [19]

Leonard, Jr. et al.

[11] 4,230,392

[45] Oct. 28, 1980

[54] ELECTRICAL SOCKET CONNECTOR

[75] Inventors: Robert D. Leonard, Jr., Poland; Charles R. Nestor, Niles, both of Ohio

[73] Assignee: General Motors Corporation, Detroit, Mich.

[21] Appl. No.: 22,821

[22] Filed: Mar. 22, 1979

[51] Int. Cl.[2] ..... H01R 4/64

[52] U.S. Cl. ..... 339/117 R; 339/18 C; 339/192 R; 339/217 S

[58] Field of Search ..... 339/117 R, 117 E, 18 C, 339/65, 192 R, 217 S, 256 R, 258 P

[56] References Cited

U.S. PATENT DOCUMENTS

| | | | |
|---|---|---|---|
| 2,397,985 | 4/1946 | Schriefer | 313/51 |
| 2,645,759 | 7/1953 | Solari | 339/8 P |
| 2,797,324 | 6/1957 | Midlock | 331/98 |
| 2,911,614 | 11/1959 | Davis | 339/182 R |
| 3,193,636 | 7/1965 | Daniels | 200/51.12 |
| 3,202,959 | 8/1965 | Keller | 339/217 S X |
| 3,271,729 | 9/1966 | Bakker et al. | 339/217 S |
| 3,336,567 | 8/1967 | Coldren | 339/192 R |
| 3,553,635 | 1/1971 | Lundergan et al. | 339/258 P |
| 3,665,509 | 5/1972 | Elkins | 339/12 V |
| 3,753,193 | 8/1973 | Teagno et al. | 339/217 S X |
| 3,853,388 | 12/1974 | Heimbrock | 339/19 RL |
| 3,957,331 | 5/1976 | Tantillo et al. | 339/6 R |
| 4,061,381 | 12/1977 | Smal | 339/8 P |
| 4,074,924 | 2/1978 | Lebecque | 339/20 |
| 4,123,131 | 10/1978 | Pearce, Jr. et al. | 339/117 R |

FOREIGN PATENT DOCUMENTS 93843 4/1969 France .

OTHER PUBLICATIONS

IBM Technical Disclosure Bulletin, vol. 13, No. 11, pp. 3341 and 3342.

*Primary Examiner*—Roy Lake
*Assistant Examiner*—DeWalden W. Jones
*Attorney, Agent, or Firm*—F. J. Fodale

[57] ABSTRACT

A socket connector is detachably connected to an oxygen sensor post terminal. The connector includes a connector body which comprises a housing and a cover which are secured together to form two longitudinal series of chambers and a socket. A terminal and attached wire conductor are disposed in each longitudinal series of chambers with the wire conductor leading out of the connector body. The connector body has elastomeric seal pads which seal the wire conductors and a vented socket seal.

5 Claims, 5 Drawing Figures

ELECTRICAL SOCKET CONNECTOR

This invention relates generally to electrical socket connectors and more particularly to electrical socket connectors for detachable connection to post terminals of oxygen sensors and the like.

U.S. patent application Ser. No. 953,412, filed Oct. 23, 1978 and assigned to the assignee of this invention, discloses an electrical socket connector which is detachably connected to an oxygen sensor post terminal having a number of ring contacts. The socket connector comprises a one-piece connector body which has a corresponding number of longitudinal terminal cavities. The terminal cavities are vertically arranged and have appropriately sized bottom wall slots which receive the post terminal. Each cavity contains a terminal (secured to an insulated wire conductor) which has a channel shaped contact comprising resilient side rail portions which biasingly engage a particular ring contact across its diameter. The socket connector is sealed by a separate boot which has rear flaps which close a rear assembly opening and seal around the insulated wire conductors. The boot also has an integral collar which provides a vented seal for the post terminal and also functions as a partial socket.

The one-piece connector body is molded and has its terminal cavities and bottom wall slots shaped to be formed by abutting mold cores which facilitates molding the connector body of high temperature dielectric materials which require higher molding pressures. The one-piece molded connector body, however, has open ended terminal cavities and lacks a positive socket structure. Consequently the socket connector requires a rather complicated boot for sealing both ends of the terminal cavities. The boot is further complicated by an integral collar which provides a vented seal while also partially providing the socket lacking in the connector body. The terminal channel shaped contacts are also quite complicated as the contacts include guiding spring tongues to compensate for the lack of a positive socket structure in the connector body and resilient terminal side rail portions which are displaced inwardly because of the terminal cavity and bottom wall slot shapes.

Broadly the object of this invention is to provide an improved electrical socket connector of the above-noted type.

More particularly the object of this invention is to provide an electrical socket connector having a molded connector body with cavities, slots and other conformations which are shaped to be formed without bypassing or abutting mold cores thereby further facilitating molding the connector body of high temperature dielectric materials which require higher molding pressures, such as Ryton, a phenolic thermoplastic, produced by Phillips Chemical Co., or rigid silicones.

Another object of the invention is to provide a socket connector having a closed-end connector body which includes positive socket structure.

Still another object of the invention is to provide a socket connector which utilizes terminals having channel shaped contacts of relatively simple design.

Still another object of this invention is to provide a socket connector which does not require a complicated boot for sealing.

The above objects are generally accomplished by use of a connector body comprising a uniquely shaped housing and cover which can be molded without bypassing or abutting mold cores and which when assembled house terminals and seals of relatively simple design.

A feature of the invention is that the terminals float freely within the connector body for proper mating and alignment with the post terminal.

Another feature of the invention is that the connector is vented and yet effectively sealed against excessive moisture by insulated wire conductor seals and a breathable socket seal housed in the assembled connector body.

Another feature of the invention is that the connector body housing laterally receives and temporarily retains the terminals to facilitate assembly.

Another feature of the invention is that the terminal channel contacts do not require separate spring tongues to guide the post terminal nor resilient side rail portions which are inwardly displaced.

Another feature of the invention is that the connector body has a common seal chamber for all the terminal cavities which simplifies the arrangement for sealing around the insulated wire conductors leading out of the connector body.

Other objects and features of the invention will become apparent to those skilled in the art as the disclosure is made in the following detailed description of a preferred embodiment of the invention as illustrated in the accompanying sheet of drawing in which.

Figure 1:
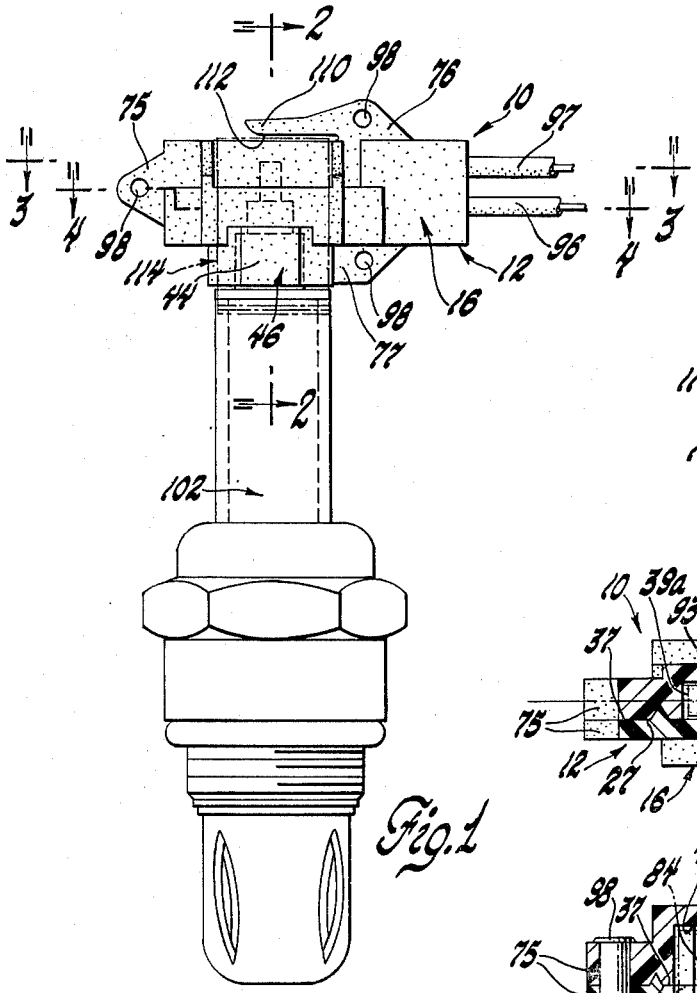
FIG. 1 is an elevation showing the electrical socket connector of this invention attached to an oxygen sensor.

Referring now to the drawing the socket connector 10 comprises a connector body 12 (housing 14 and cover 16), small and large terminals 18 and 20, a pair of foam rubber seal pads 22 and a socket seal 24.

Figure 2:
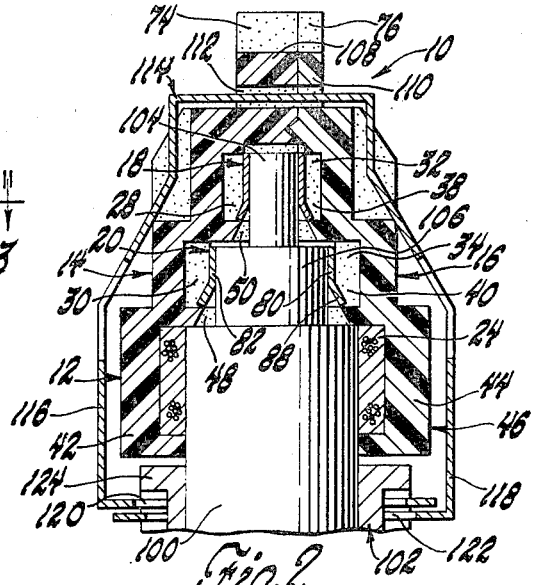
FIG. 2 is a section taken substantially along the line 2—2 of FIG. 1 looking in the direction of the arrows.
Figure 3:
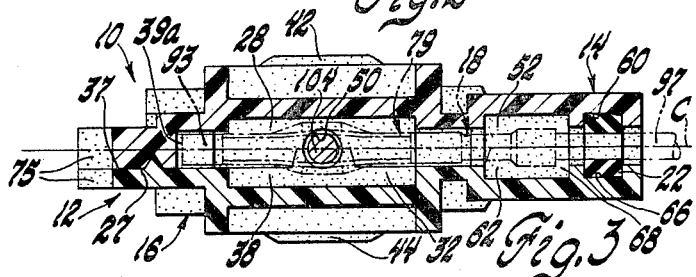
FIG. 3 is a section taken substantially along the line 3—3 of FIG. 1 looking in the direction of the arrows.
Figure 4:
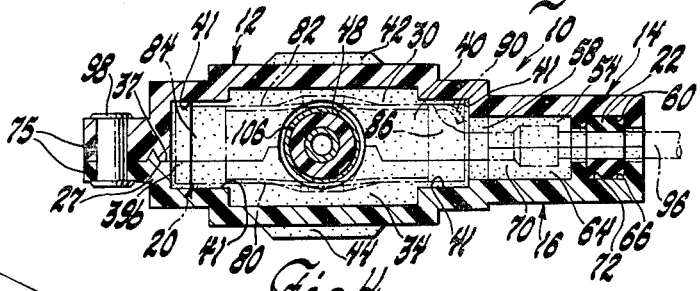
FIG. 4 is a section taken substantially along the line 4—4 of FIG. 1 looking in the direction of the arrows.
Figure 5:
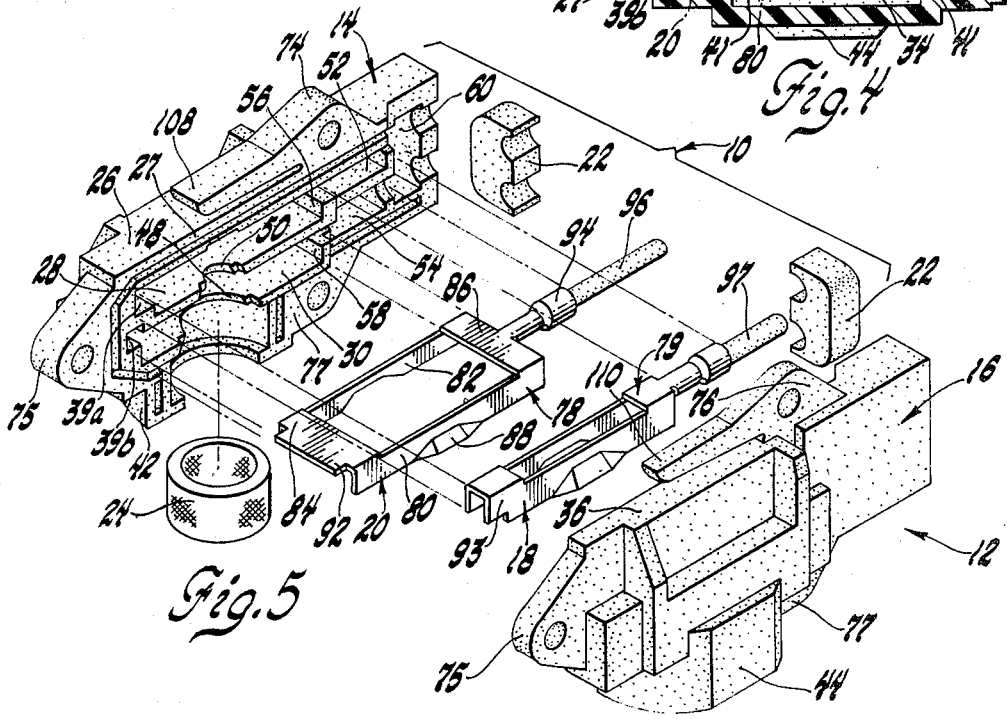
FIG. 5 is an exploded perspective view of the socket connector shown in FIGS. 1–4.

The housing 14 has a wide forward portion 26 for about $\frac{2}{3}$ of its length which has an overcenter mating face 27 with respect to the connector centerplane indicated at C in FIGS. 2 and 3. The wide forward portion 26 has two longitudinal, vertically stacked, cavities 28 and 30. The cover 16 has a corresponding narrow forward portion 36 which has an under center mating face 37 and vertically stacked cavities 32 and 34 and are the major portions of the contact chambers 38 and 40 cooperatively formed when the housing 14 and cover 16 are secured together. The longitudinal partition wall between the contact chambers 38 and 40 is stepped at the front end to provide index slots **39*a*, 39*b* unique to each chamber. The side walls of each contact chamber are stepped inwardly at each end to provide four corner pads 41** in each contact chamber.

The forward portions 26 and 36 have depending bosses 42 and 44 which mate at the connector centerplane C to form a socket 46 intermediate the ends of the contact chambers 38 and 40. The socket 46 communicates with the contact chambers 38 and 40 via a reduced concentric passage 48 cooperatively formed by the bottom walls of the lower cavities 28, 30 and an even smaller concentric passage 50 formed by the longitudinal partition walls between the cavities 28 and 30 and the cavities 32 and 34.

The rearward portion of the housing 14 has upper and lower intermediates stacked cavities 52 and 54 which are longitudinally aligned with the forward cavities 28 and 30 respectively and separated therefrom by slotted vertical partition walls 56 and 58. The two intermediate cavities 52 and 54 communicate with a common end cavity 60. The rearward portion of the cover 16 has mating intermediate cavities 62 and 64 and a common end cavity 66 which cooperatively form stacked intermediate chambers 68 and 70 and a common seal chamber 72 when the housing 14 and cover are secured together. The vertical walls defining the seal chamber 66 are scalloped at their interface to provide passages for insulated wire conductors.

The rearward portions of the housing 14 and the cover 16 are about the same width for the most part and mate at the connecter centerplane C. Part of the top walls of the rearward portions, however, mate overcenter so that the triangular integral projections 74 and 76 have planar mating faces. These triangular projections have mating apertures which is also true of the forward triangular projections 75 and the gusset plate portions 77.

The housing 14 and cover 16 are designed so that each can be molded without either bypassing or abutting cores to form their respective cavities, slots and other conformations. This facilitates molding these parts of high temperature materials which require higher molding pressures. Examples of such materials are rigid silicones which are thermosetting materials having recommended continuous operating temperatures of 482° F. (250° C.) and peak temperatures of 650° F. (343° C.). Another example of such a material is Ryton, a phenolic thermoplastic material produced by Phillips Chemical Co. which has a recommended continuous operating temperature of 392° F. (200° C.) and a peak temperature of 500° F. (260° C.).

The terminals 18 and 20 are similar in construction. The larger terminal 20 comprises a channel shaped contact portion 78 comprising side rails 80 and 82 connected across the top by webs 84 and 86 at each end. The side rails 80 and 82 each have a central lower guidance flare 88. The side rail 82 has an inwardly bent scrape lock tab 90. The front end web 84 has a coplanar index projection 92 which cooperates with the index slot **39*b* in chamber 40 to insure that the terminal is inserted right side up. The rear end web 86 has an integral conventional crimp barrel attachment 94 projecting rearwardly which attaches the terminal 20 to an insulated wire conductor 96**.

The terminal 18 attached to the insulated wire conductor 97 is essentially the same as the terminal 20 except that its channel shaped contact portion 79 is slightly shorter, much narrower, and has a U-shaped index projection 93 which fits the larger index slot **39*a* in contact chamber 38**.

The foam rubber pads 22 are the same size and are sized to fit the end cavities 60 and 66 which are also the same size. The foam rubber pads 22 have notched faces which abut and seal around the insulated wire conductors 96, 97 when the socket connector is assembled.

The socket seal 24 preferably comprises an annular member of wire mesh or compacted wire strands which is permeable for venting the interior of the connector body 12.

The socket connector 10 may be assembled in the following manner.

One of the seal pads 22 is inserted into the end cavity 60 of the housing 14 after which the terminal 20 is laterally inserted into the serially arranged cavities 30, 54 and 60. The index projection 92 unique to the contact portion 78 and index slot **39*b* unique to the forward cavity 30 insures that the terminal 20 is inserted into the proper set of cavities in the proper orientation. During insertion scrape lock tab 90 engages the slotted partition wall 58 and acts as a one-way retainer which temporarily prevents removal of the terminal 20 from the housing 14. The crimp portion 94 extends through the slot of the partition wall 58 and terminates in the intermediate cavity 54. The insulated wire conductor 96 extends through the end cavity 60 where it is engaged in one of the notches in the face of the sealing pad 22**.

The terminal 18 is laterally inserted into the serially arranged cavities 28, 52 and 60 of the housing 14 in the same manner and the socket seal 24 is simply placed in the socket half provided by the housing boss 42. The terminals 18 and 20 and the socket seal 24 may be assembled simultaneously or in any order so long as the one seal pad 22 is inserted in the end cavity 60 before either of the terminals 18 and 20 are assembled. After all of these components have been assembled to the housing, the other seal pad 22 is inserted into the end cavity 66 of the cover 16 and the cover 16 is mated to the housing 14. Proper mating is assisted by complementary wedge-shaped grooves and ribs at the mating faces of the housing 14 and cover 16 which interfit and also enhance sealing at the interface between the housing 14 and the cover 16. The housing 14 and cover 16 are permanently secured together by three rivets 98 respectively fastening the apertured projections 74 and 76; the apertured projections 76 and apertured gusset plate portions 77.

The completed socket connector 10 houses the terminals 18 and 20 in a vertically stacked arrangement for detachable connection to the post terminal 100 of the oxygen sensor 102 shown in FIGS. 1 and 2. In order to accommodate out-of-roundness of the post terminals, eccentricities and other manufacturing variations, the channel shaped contacts 78 and 79 float freely in the contact chambers 38 and 40. More particularly, the height and length of the side rails are slightly undersized with respect to the corresponding dimensions in the contact chamber. This enables the entrapped channel shaped contacts to adjust longitudinally and laterally to accommodate the position of the post terminal. The insulated wire conductors 96 and 97 leading out of the socket connector 10 are completely sealed by the foam rubber pads 22 housed in the connector body 12. Furthermore the connector body 12 has positive socket structure including the socket 46 which houses a porous socket seal 24 which engages the post terminal 100 to effectively seal the connector body interior against excessive moisture while venting the interior for proper operation of the oxygen sensor 102. For proper venting, the socket 46 bottom lip inner diameter is larger than the inner diameter of the porous socket seal 24 as clearly shown in FIG. 2.

The socket connector 10 is simply plugged onto the post terminal 100 and the terminals 18 and 20 respectively biasingly engage the ring contacts 104 and 106 at diametrically opposed locations. While the oxygen sensor 102 has two ring contacts 104 and 106, other oxygen sensors have post terminals with one, three or four ring contacts and the socket connector 10 can be suitably modified to house a corresponding number of terminals although the socket connector is particularly advantageous for multiple terminal configurations.

Also in some instances it may be desirable to include a connector lock for securing the socket connector 10 to the post terminal 100. Consequently the triangular projections 74 and 76 include longitudinal extensions 108 and 110 which form a mounting slot 112 for a sheet metal connector lock 114.

The sheet metal connector lock 114 is a rather conventional design comprising two resilient L-shaped flanges 116 and 118; the angled end portions of which have apertures 120 and 122 respectively which are normally offset from each other as shown in FIG. 2. When the L-shaped flanges 116 and 118 are squeezed together the apertures 120 and 122 align sufficiently to clear the shoulder 124 and permit the socket connector 10 to be detached from the post terminal 100. For attachment the apertures 120 and 122 are realigned by squeezing and the socket connector 10 is simply plugged on the post terminal 100 and released.

We wish it to be understood that we do not desire to be limited to the exact details of construction shown and described, for obvious modifications will occur to a person skilled in the art.

The embodiments of the invention in which an exclusive property or privilege is claimed are defined as follows:

1. A socket connector for post terminals, comprising:

a connector body comprising a housing and a cover secured together forming a longitudinal series of chambers and a socket, said longitudinal series of chambers including an elongated chamber at one longitudinal end of the connector body which is closed at the one end and which has an opening in its bottom wall aligned with the socket, and a seal chamber at the opposite longitudinal end of the connector body having an exit opening, a terminal and attached wire conductor disposed in the longitudinal chambers with the wire conductor extending through the seal chamber and leading out of the connector body through said exit opening, said terminal having a channel shaped contact portion which is disposed in the elongated chamber and which includes a pair of laterally spaced side rails, said terminal and attached wire conductor being laterally insertable into cavity portions of the housing forming part of the longitudinal series of chambers for assembly into the housing prior to securement of the cover, elastomeric seal means disposed in the seal chamber sealing around a portion of the wire conductor extending therethrough, and a vented socket seal disposed in the socket of the connector body.

2. A socket connector for post terminals, comprising:

a connector body comprising a housing and a cover secured together forming a first and second longitudinal series of chambers and a socket, each said longitudinal series of chambers including an elongated chamber at one longitudinal end of the connector body which is closed at the one end and which has an opening in its bottom wall aligned with the socket, and a seal chamber at the opposite longitudinal end of the connector body having an exit opening, a terminal and attached wire conductor disposed in each longitudinal series of chambers with the wire conductor extending through the seal chamber and leading out of the connector body through said exit opening, each said terminal having a channel shaped contact portion which is disposed in one of the elongated chambers and which includes a pair of laterally spaced side rails, each said terminal and attached wire conductor being laterally insertable into cavity portions of the housing forming part of one of the longitudinal series of chambers for assembly into the housing prior to securement of the cover, elastomeric seal means disposed in the seal chamber sealing around a portion of the wire conductor extending therethrough, and a vented socket seal disposed in the socket of the connector body.

3. A socket connector for post terminals, comprising:

a connector body comprising a housing and a cover secured together forming a first and second longitudinal series of chambers and a socket, said first and second longitudinal series of chambers each including an elongated chamber at one longitudinal end of the connector body which is closed at the one end and which has an opening in its bottom wall aligned with the socket, said first and second longitudinal series of chambers having a common seal chamber at the opposite longitudinal end of the connector body having exit openings, a terminal and attached wire conductor disposed in each longitudinal series of chambers with the wire conductor extending through the common seal chamber and leading out of the connector body through one of the exit openings, each said terminal having a channel shaped contact portion which is disposed in one of the elongated chambers and which includes a pair of laterally spaced side rails, said terminal and attached wire being laterally insertable into cavity portions of the housing forming part of one of the longitudinal series of chambers for assembly into the housing prior to securement of the cover, elastomeric seal pads disposed in the common seal chamber sealing around portions of the wire conductors extending therethrough, and a vented socket seal disposed in the socket of the connector body.

4. A socket connector for post terminals, comprising:

a connector body comprising a housing and a cover secured together forming a longitudinal series of chambers and a socket, said longitudinal series of chambers including an elongated chamber at one longitudinal end of the connector body which is closed at the one end and which has an opening in its bottom wall aligned with the socket, a second chamber adjacent said elongated chamber, and separated therefrom by a slotted partition wall, and an exit opening at the opposite longitudinal end of the connector body, a terminal and attached wire conductor disposed in the longitudinal chambers with the wire conductor leading out of the connector body through said exit opening, said terminal having a channel shaped contact portion which is disposed in the elongated chamber and which includes a pair of laterally spaced side rails, said terminal and attached wire conductor being laterally insertable into cavity portions of the housing forming part of the longitudinal series of chambers for assembly into the housing prior to securement of the cover, and one of said side rails having a lock tab which engages the slotted partition wall to retain the terminal in the housing in the absence of the cover.

5. A socket connector for post terminals, comprising:

a connector body comprising a housing and a cover secured together forming a first and second longitudinal series of chambers and a socket, said first and second longitudinal series of chambers each including an elongated chamber at one longitudinal end of the connector body which is closed at the one end and which has an opening in its bottom wall aligned with the socket, a second chamber adjacent said elongated chamber, and separated therefrom by a slotted partition wall, and a seal chamber at the opposite longitudinal end of the connector body having an exit opening, a terminal and attached wire conductor disposed in each longitudinal chamber with the wire conductor extending through the seal chamber and leading out of the connector body through said exit opening, said seal chamber having means sealing around a portion of the wire conductor extending therethrough, each said terminal having a channel shaped contact portion which is disposed in the elongated chamber and which includes a pair of laterally spaced side rails, each said terminal and attached wire conductor being laterally insertable into cavity portions of the housing forming part of the longitudinal series of chambers for assembly into the housing prior to securement of the cover, one of said side rails of each said terminal having a lock tab which engages an associated slotted partition wall to retain the said terminal in the housing in the absence of the cover, and said socket having a vented seal means.

* * * * *